US005704310A

United States Patent [19]

Cittadini

[11] Patent Number: 5,704,310

[45] Date of Patent: Jan. 6, 1998

[54] BOAT WITH FOLDING TRANSOM

[76] Inventor: Daniel Cittadini, 44 Route Natioanle - Demeurs, 58130 Guerigny, France

[21] Appl. No.: 697,561

[22] Filed: Aug. 28, 1996

[30] Foreign Application Priority Data

Sep. 5, 1995 [FR] France ..... 95 10378

[51] Int. Cl.[6] ..... B63B 7/00

[52] U.S. Cl. ..... 114/354; 114/343

[58] Field of Search ..... 114/354, 352, 114/353, 343

[56] References Cited

U.S. PATENT DOCUMENTS 1,573,958 2/1926 Whall .
2,353,013 7/1944 Clark ..... 114/354
2,504,225 4/1950 Randrup ..... 114/354
2,522,910 9/1950 Wayne .
2,830,308 4/1958 Green .
3,075,207 1/1963 Lewis .
3,108,295 10/1963 Schor et al. .
4,911,095 3/1990 Kaye .

*Primary Examiner*—Sherman Basinger
*Attorney, Agent, or Firm*—Fisher, Christen & Sabol

[57] ABSTRACT

A collapsible hull boat has a folding transverse transom and a rigid transom board substantially similar in shape to the transom when deployed. The rigid transom board is attached from the outside of the hull to the deployed transom so as to cover its exterior face and is removably fixed to the deployed transom in order to protect it and to withstand the thrust of a motor fixed to the rigid transom board to propel the boat.

7 Claims, 3 Drawing Sheets

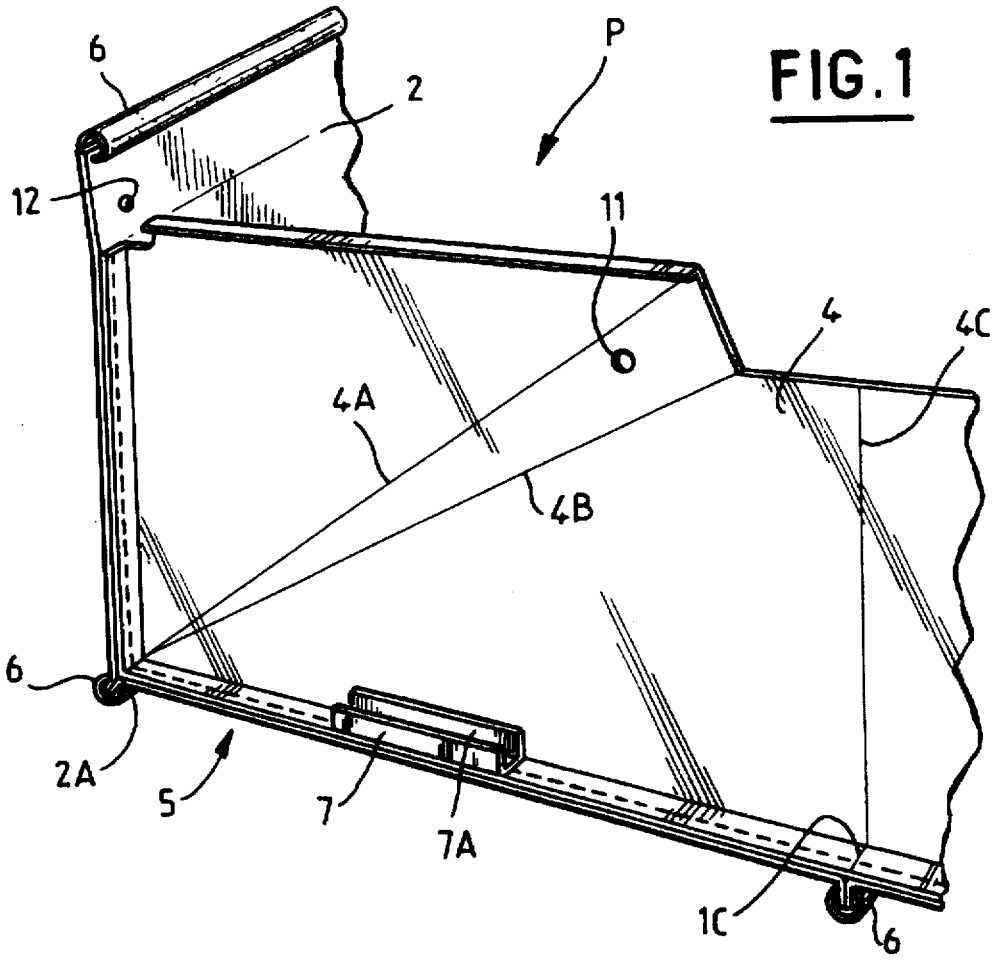
FIG. 1
FIG. 2
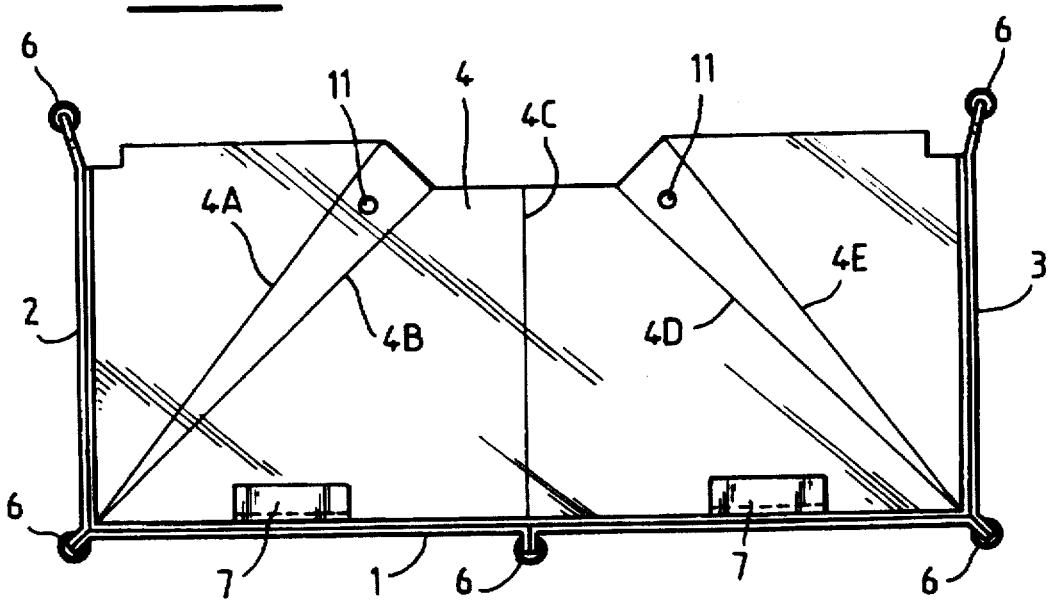

BOAT WITH FOLDING TRANSOM

BACKGROUND OF THE INVENTION

1. Field of the Invention

The present invention concerns a collapsible hull boat, of the dinghy type, for example, having a folding transverse transom.

2. Description of the Prior Art

In boats of this kind it is difficult to protect said transom from being damaged and to enable it to withstand the thrust of a propulsion motor fixed to it.

An object of the present invention is to solve these problems.

SUMMARY OF THE INVENTION

To this end, in accordance with the present invention, the collapsible hull boat has a folding transverse transom and a rigid transom board substantially similar in shape to said transom when deployed and adapted to be attached from the outside of said hull to said deployed transom so as to cover its exterior face and to be fixed removably to said deployed transom in order to protect it and to withstand the thrust of a motor fixed to said rigid transom board to propel said boat.

Preferably, said rigid transom board has a peripheral rim fitting at least partly around the peripheral contour of said deployed transom, so that said transom board not only provides total protection of said transom but also bears on all of the longitudinally rigid parts of the boat (such as the stringers). It can therefore transfer all of the motor thrust to the boat.

In one advantageous embodiment, the transom includes at least one receptacle for receiving and longitudinally retaining a part of the periphery of said rigid transom board. This receptacle is preferably attached to the lower part of the transom.

To fasten said rigid transom board to the transom of the boat, this board may include first means for attaching it to a middle upper part of said deployed transom and second means for attaching it to the rear upper part of the flanks of said deployed hull.

To increase further the rigidity of the transom of the collapsible boat and to provide an appropriate seating for an outboard motor, a stiffener crossmember adapted to be attached from the interior of said hull to said deployed transom and to be fixed to said rigid transom board may be provided. This crossmember may advantageously be fixed to said rigid transom board by said first fastening means.

In one particular embodiment, in which said transom is fastened to the bottom and to the flanks of said hull by a peripheral bead projecting towards the stern of the boat, said receptacle is mounted on the upper face of the lower part of said bead corresponding to said bottom of said hull and said peripheral rim of the transom board surrounds the parts of said bead corresponding to said lateral flanks of the hull.

Said rigid transom board is preferably a solid piece of synthetic material incorporating, for example, inserts forming part of said first and second fastening means.

The figures of the appended drawings show how the invention may be put into effect. In these figures the same reference numbers identify similar components.

BRIEF DESCRIPTION OF THE DRAWINGS

FIG. 1 is a partial rear perspective view of the stern of a collapsible hull boat in accordance with the present invention.

FIG. 2 is an elevation view of the exterior of the transom from FIG. 1.

DETAILED DESCRIPTION OF THE PREFERRED EMBODIMENT

Figure 3:
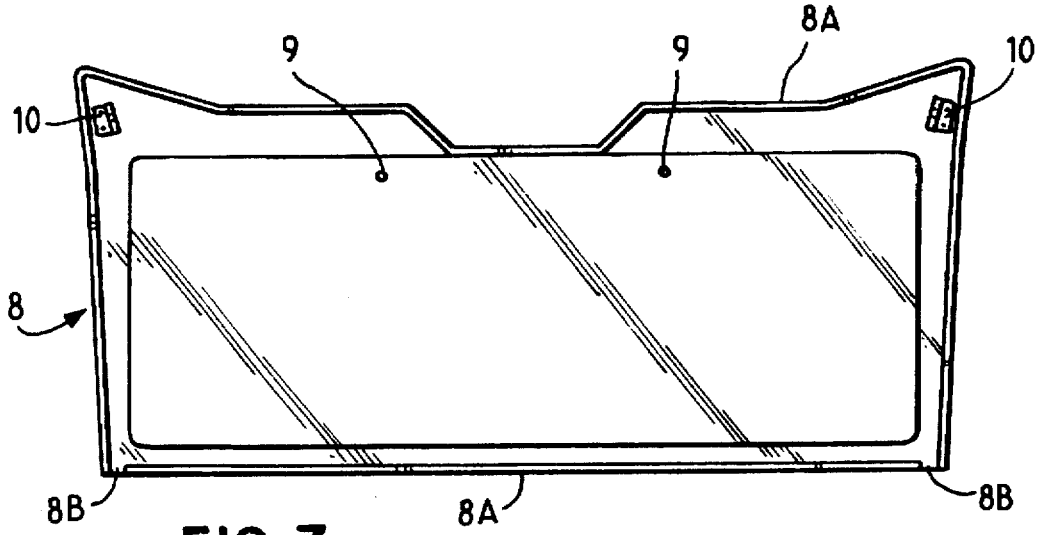
FIG. 3 is a front view of a rigid transom board for the transom from FIGS. 1 and 2.
Figure 4:
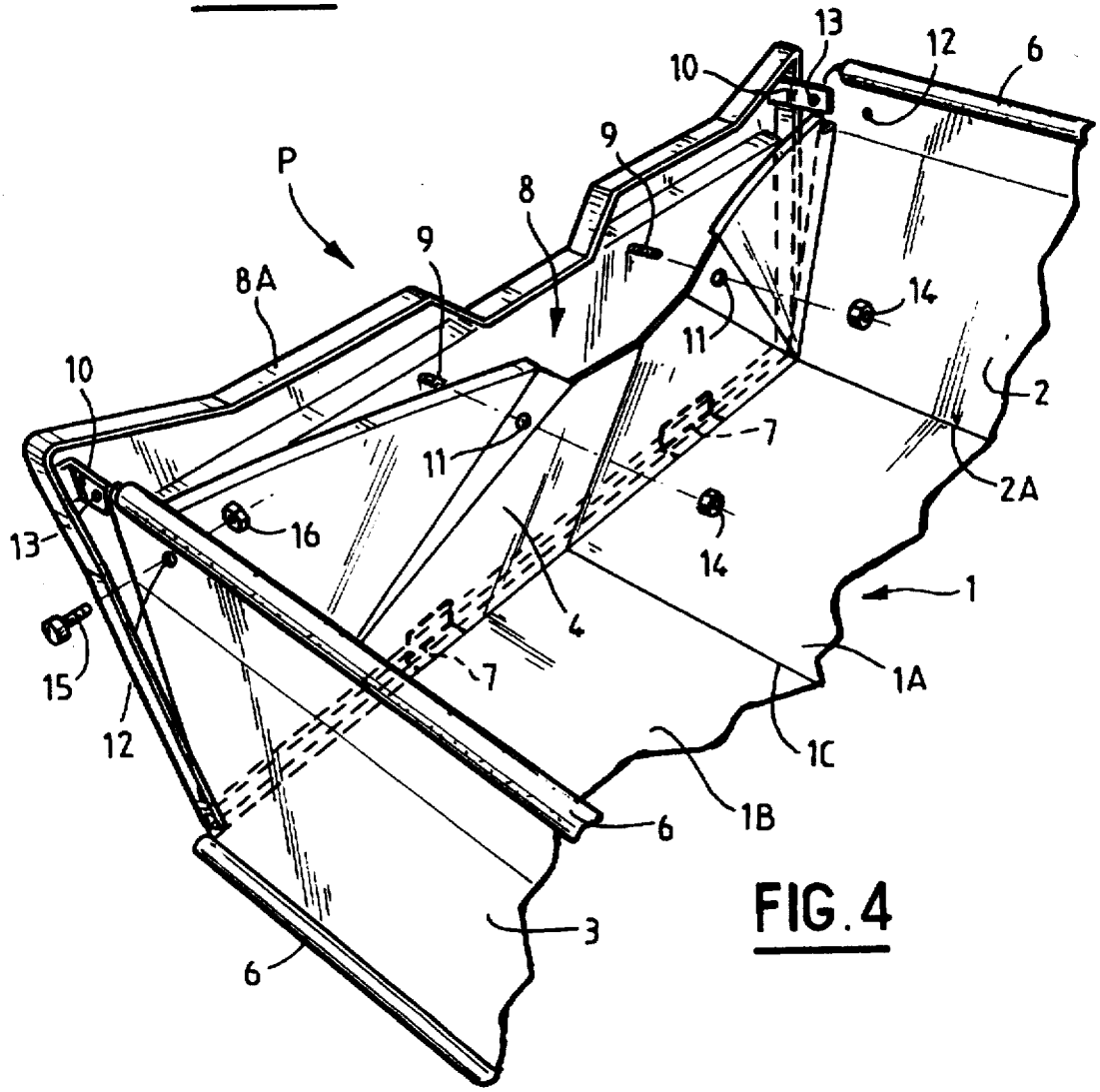
FIG. 4 is a partial perspective view of the interior of the collapsible hull boat showing the fastening of the rigid transom board to the transom of the boat.

The stern P of the collapsible hull boat part of which is shown in perspective in FIGS. 1, 4, 6, and 7 comprises a bottom 1, side flanks 2 and 3 and a folding transverse transom 4.

It can be seen that the bottom 1 is made up of two parts 1A and 1B assembled together and foldable along a longitudinal assembly and folding line 1C and that the side flanks 2 and 3 are assembled to said bottom 1 along longitudinal assembly and folding lines 2A and 3A. The folding transverse transom 4 comprises a plurality of folding lines 4A, 4B, 4C, 4D and 4E.

The components 1 through 4 are assembled together by means of a peripheral bead 5 projecting astern of the boat.

The assembly and folding lines 1C, 2A and 3A also form beads disposed longitudinally relative to the boat.

These beads and the edges of the side flanks 2 and 3 are protected and stiffened by longitudinal bars 6.

Two bars 7 are mounted in the top face of the lower part of the bead 5 corresponding to the bottom 1 of the boat. They are made of aluminum, for example, and incorporate a groove 7A transverse to the boat and open at the top.

As shown in FIG. 3, the invention provides a rigid transom board 8 thermoformed or molded from synthetic material, for example, adapted to stiffen the folding transom 4 in the deployed position.

The rigid transom board 8 has a peripheral rim 8A interrupted at the corners 8B of its lower part. The transom board 8 has bolts 9 in the middle of its upper part and lateral fixing lugs 10 incorporated in the form of inserts during the fabrication of said transom board 8, for example.

Accordingly, when the collapsible hull boat is unfolded, said rigid transom board 8 may be fitted so that the lower part of its rim 8A is inserted into the groove 7A in the bars 7 and said board covers the exterior of the transom 4. At the level of the folding lines 2A and 3A the bead 5 fits into the interruptions 8B in the rim 8A and said rim 8A is applied to the exterior faces of the flanks 2 and 3 (see FIG. 4).

Holes 11 in corresponding relationship to the bolts 9 are provided in the transom 4. Holes 12 are provided in the lateral flanks 2 and 3 and can be lined up with holes 13 in the lugs 10.

Figure 6:
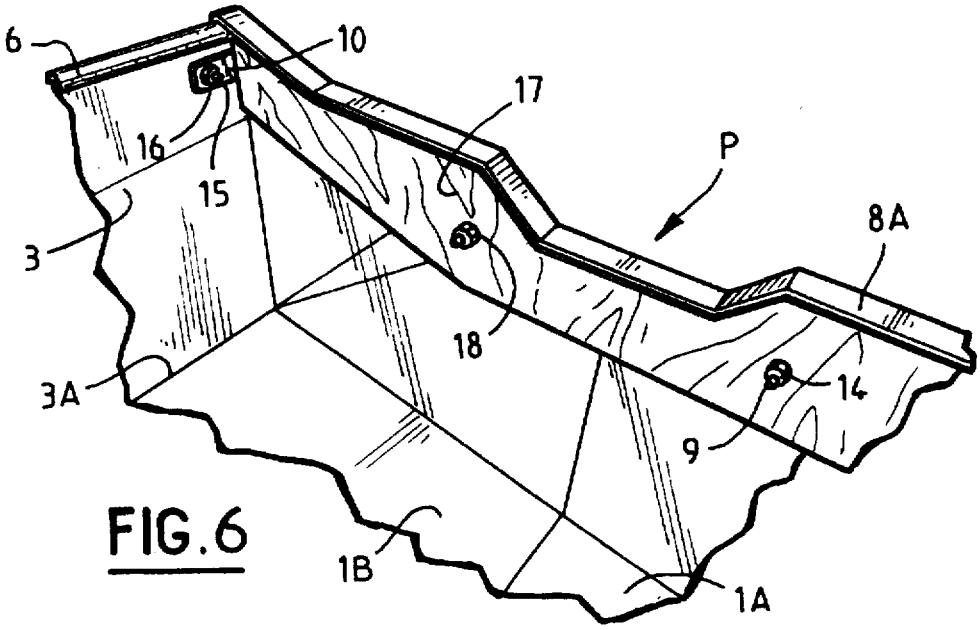
FIG. 6 is a partial perspective view from the interior of the boat of the transom of the latter after final fixing of the rigid transom board and the stiffener crossmember.
Figure 7:
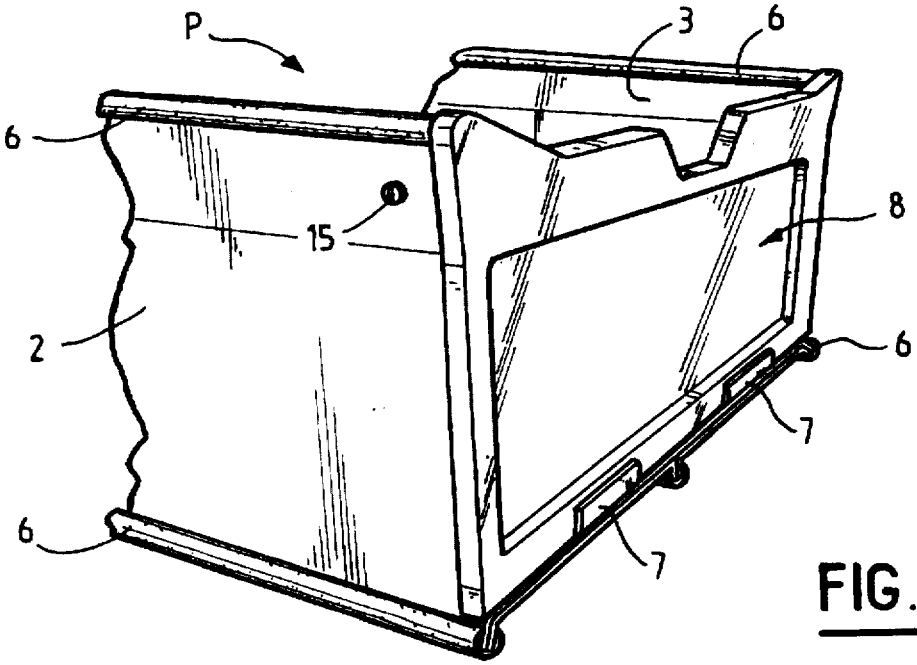
FIG. 7 is a partial three-quarter rear perspective view of the interior of the collapsible boat showing the transom of the boat after fixing said rigid transom board and said stiffener crossmember.

Accordingly, when the bolts 9 have been inserted into the holes 11 and the holes 12 and 13 have been lined up, the rigid transom board 8 covers all of the exterior of the deployed transom 4 and the transom board and the transom of the boat can be fastened together by means of nuts 14 that are screwed onto the bolts 9 and by means of nuts and bolts 15, 16 passing through the aligned holes 12, 13 (see FIGS. 6 and 7).

Figure 5:
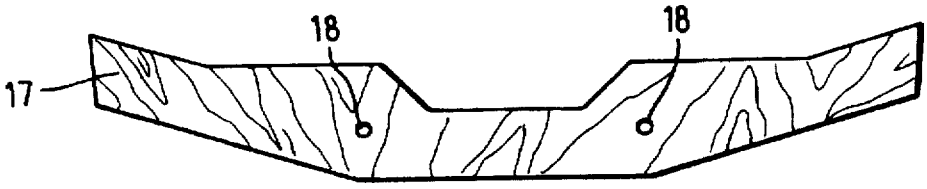
FIG. 5 shown an additional stiffener crossmember for the transom.

To stiffen the transom further and to facilitate the fixing of an outboard motor, a stiffener crossmember 17 may be provided (FIG. 5) with holes 18 through which the bolts 9 can be passed and adapted to be fastened to the transom board and the transom by cooperation of the bolts 9 and nuts 14.

I claim:

1. A collapsible hull boat having a bottom and lateral flanks, further comprising:

a folding transverse transom fastened to said bottom and lateral flanks by a peripheral bead projecting astern of said boat, said peripheral bead having a lower part corresponding to said bottom, said lower part having an upper face supporting a receptacle; and a rigid transom board substantially similar in shape to said folding transom when said folding transom is deployed, said rigid transom board being adapted to be attached from the outside of said hull to said deployed transom so as to cover an exterior face of said deployed transom and to be fixed removable to said deployed transom in order to protect said deployed transom and to withstand the force of a motor fixed to said rigid transom board, said rigid transom board having a peripheral rim fitting at least partly around the peripheral contour of said deployed transom and surrounding the parts of said bead corresponding to said lateral flanks, the periphery of said rigid transom board having a lower part able to be received and longitudinally retained by said receptacle.

2. The boat claimed in claim 1 wherein said rigid transom board includes first means for attaching it to a middle upper part of said deployed transom.

3. The boat claimed in claim 2 wherein a stiffener crossmember is fixed to said rigid transom board by said first attaching means.

4. The boat claimed in claim 1 wherein said rigid transom board includes second means for attaching it to a rear upper part of said flanks of said hull when said hull is deployed.

5. A boat as claimed in claim 1 including a stiffener crossmember adapted to be attached from an interior of said hull to said deployed transom and to be fixed to said rigid transom board.

6. The boat claimed in claim 5 wherein said stiffener crossmember is fixed to said rigid transom board by a first fastening means.

7. The boat claimed in claim 1 wherein said rigid transom board is a solid piece of synthetic material.

* * * * *